US005226366A

United States Patent [19]

Schlife et al.

[11] Patent Number: 5,226,366

[45] Date of Patent: Jul. 13, 1993

[54] METHOD AND APPARATUS FOR ALIGNING SCREENS USED FOR APPLICATION OF INK PATTERNS TO A SUBSTRATE

[75] Inventors: Leo J. Schlife; Geoffrey A. Mccue, both of Lawrence, Kans.

[73] Assignee: Screen Masters, Inc., Lawrence, Kans.

[21] Appl. No.: 834,882

[22] Filed: Feb. 11, 1992

[51] Int. Cl.[5] ..... B41F 1/34

[52] U.S. Cl. ..... 101/485; 101/DIG. 36; 101/481; 101/114; 101/127.1; 33/614; 33/617; 33/620

[58] Field of Search ..... 101/114, 127.1, 128.4, 101/129, DIG. 36, 128, 128.1, 485, 481; 33/614, 616, 617, 619, 620, 621; 74/29, 120

[56] References Cited

U.S. PATENT DOCUMENTS

| | | | |
|---|---|---|---|
| 719,595 | 2/1903 | Huss | 74/29 |
| 1,860,361 | 5/1932 | Huebner | 33/614 |
| 2,353,716 | 7/1944 | Estey et al. | 74/29 |
| 2,679,695 | 6/1954 | Bungay | 33/614 |
| 2,736,968 | 3/1956 | Faeber | 33/614 |
| 2,745,186 | 5/1956 | Faeber | 101/DIG. 36 X |
| 4,575,234 | 3/1986 | Black et al. | 101/128.21 X |
| 4,907,505 | 3/1990 | Ericsson et al. | 101/DIG. 36 X |
| 5,129,155 | 7/1992 | Hoffman et al. | 101/DIG. 36 X |
| 5,133,256 | 7/1992 | Keaton | 101/481 |

FOREIGN PATENT DOCUMENTS

| | | | |
|---|---|---|---|
| 0154088 | 11/1981 | Japan | 101/128.4 |
| 0012650 | 1/1982 | Japan | 101/DIG. 36 |
| 0291134 | 12/1986 | Japan | 101/DIG. 36 |

*Primary Examiner*—Edgar S. Burr
*Assistant Examiner*—Christopher A. Bennett

[57] ABSTRACT

An apparatus and method are provided for registration of screens used in ink transfer processes for the printing of patterns on substrates such as clothing and other articles. The apparatus includes a platen surface and registration members that are mounted for movement toward and away from opposite sides of the platen. A pair of the registration members are coupled so that they move in mirror image in relation to a fixed point on the platen. When the screen frame is positioned on the platen, the registration members are activated to move inwardly toward the fixed point on the platen to center the screen in relation to the fixed point. Artwork is applied to the screen in alignment with underlying indicia provided on the platen and the screen is then processed to form a stencil in the screen. The stenciled screen is then aligned on the printing machine using the same or different apparatus by contacting the screen with registration members at the same points of contact used when the screen was aligned for application of the artwork.

22 Claims, 4 Drawing Sheets

METHOD AND APPARATUS FOR ALIGNING SCREENS USED FOR APPLICATION OF INK PATTERNS TO A SUBSTRATE

BACKGROUND OF THE INVENTION

The present invention relates in general to printing machines of the type which utilize a screen that has been coated with an emulsion and has been selectively exposed to present a stencil or pattern on the screen through which ink may flow for application to a substrate. More particularly, this invention relates to a method and apparatus for aligning the pattern in relation to the screen and then the screen in relation to the substrate.

Screen-type printing machines are widely used for the application of various types of inks to t-shirts, sweatshirts, baseball hats and other types of substrates to form patterns such as lettering and logos. The screens used in these types of machines are prepared by coating a photosensitive emulsion onto the mesh portion of the screens and allowing the emulsion to dry. The artwork pattern is then applied to the screen and the screen is exposed to a light spectrum which causes curing and hardening of that portion of the emulsion that is not covered by the opaque artwork pattern. The artwork is removed from the screen and the screen is washed to remove the uncured emulsion from the area of the screen which was shielded from the developing light. A stencil is thereby formed in the screen and after drying, the screen can be clamped in the printing machine and used to apply ink to the underlying substrate. Because the cured emulsion is impermeable to the ink, the ink under pressure flows through the screen only in those areas where the emulsion did not cure due to the presence of the overlying artwork.

In order to ensure that the pattern is applied to the substrate at the desired location, it is important that the screen be "registered" or accurately positioned so that the pattern formed in the screen is aligned on the substrate. This is particularly important when multi-colored patterns are being applied which require the use of multiple screens. In multi-colored processes, a portion of the desired pattern is applied to one screen while one or more portions of the pattern are applied to other screens. The screens are then clamped to rotatable arms which allow the screens to be successively positioned over the substrate to apply portions of the composite pattern. If even one of the screens are slightly misaligned, a poor quality composite pattern will result.

In many conventional processes, alignment of these screens on the printing machine is a time consuming process as the machine operator must visually align and clamp each screen. Typically, the operator will clamp the first screen and apply ink to a test substrate. Successive screens are then loosely clamped and registered by the operator visually observing their alignment in relation to the pattern applied from the previous screen. Each screen is then repositioned as required to bring the pattern into alignment. The screens are then firmly clamped and rechecked to ensure that the tightening of the clamps has not caused misalignment of the screens. As can be readily appreciated, this process requires considerable time and greatly reduces the productivity of the printing machines, particularly when only small production runs of a particular pattern are being produced.

Various methods have been utilized in an attempt to more accurately and more quickly align the screens both when the artwork is being applied to the screen and when the screen is being readied for clamping in the press. One such method utilizes a L-shaped bracket provided on the light box where the artwork pattern is applied to the screen. The screen is simply pressed into the corner formed by the bracket to quickly position the screen in relation to an underlying grid on the light box. While this method allows the screen to be quickly positioned on the light box, it does not positively hold the screen in place. The screen may therefor shift out of alignment as the operator releases the screen to position the artwork acetate onto the screen. Moreover, significant delays are still occasioned in aligning the stenciled screen on the printing machine after it has been prepared.

Another conventional method for aligning or registering screens utilizes brackets clamped onto the frame of the screens and fixed registration pins that are positioned on the light box and the printing boards. The brackets are positioned on opposite ends or sides of the screen and include a hole and slot arrangement for receiving the fixed registration pins. The cooperating brackets and pins thus ensure that the screens are properly aligned both during the application of the artwork to the screen and during the positioning of the screen in the printing machine. This method, however, is best suited for use with screens having one standard size because of the time required to alter the pin placement for screens of differing sizes. In addition, further delays are occasioned by the mounting and removing of the brackets from the screens.

A still further method used for the registration of screens employs a complex apparatus that utilizes optical sensors to read the position of alignment marks provided on the screen. Registration pins engage the screen and reposition it in response to the readings taken by the optical sensors. While this type of device can accurately position the screen during placement of the artwork acetate and in preparation for printing, it may require as long as 30 seconds or more to register the screen. Moreover, this type of machine is extremely expensive and many small businesses cannot afford to purchase this type of a registration system.

SUMMARY OF THE INVENTION

It is an object of this invention to provide an screen registration apparatus that aligns a stenciled screen on a printing machine by simply engaging the screen at preselected points or areas of contact so that registration can be quickly and precisely accomplished without the delays and expense associated with the use of optical sensors and other conventional registration devices.

As a corollary to the preceding objective, it is another object of this invention to provide a screen registration apparatus as described that can be readily attached to a manual screen-type printing machine so that precise registration can be quickly achieved even on these types of machines.

It is also an object of this invention to provide a screen registration apparatus which quickly aligns and positively holds the screen in alignment during application of an artwork pattern to the screen so that the operator is able to quickly and accurately apply the pattern without having to also hold the screen in place.

It is a further object of this invention to provide an apparatus for registering a screen on a printing machine, which apparatus engages the screen frame at the same points of contact used to engage the screen for alignment during the application of artwork to the screen so that the ridges and depressions and other imperfections in the screen frame do not cause misalignment of the screen on the printing machine.

It is still another object of this invention to provide a screen registration apparatus that can be easily operated to quickly and precisely align screens on a printing machines so that even unskilled workers can be used to operate the printing machine.

It is a yet further object of this invention to provide a screen registration apparatus that is readily adapted for use with screens of various sizes so that processing delays are minimized when changing from one size screen to another during the operation of a printing machine.

To accomplish these and other related objects of the invention, in one aspect the invention is related to an apparatus for positioning a framed ink-transfer screen in preselected alignment in relation to an underlying surface, said apparatus comprising:

a generally flat platen presenting said underlying surface;

a first member coupled with said platen and extensible outwardly in a first direction at one side of said platen, said first member being retractable inwardly;

a second member coupled with said platen and extensible outwardly in a second direction at an opposite side of said platen, said second member being retractable inwardly and being operatively coupled with said first member so that extension or retraction of one of said first and second members causes corresponding extension or retraction of the other of said first and second members;

each of said first and second members including a contact surface positioned for engaging opposite edges of said screen when said screen is positioned on said apparatus and said first and second members are retracted inwardly;

a third member coupled with said platen and extensible outwardly in a third direction at a third side of said platen, said third member being retractable inwardly; and a fourth member coupled with said platen and positioned at a fourth side of said platen, each of said third and fourth members including a contact surface positioned for engaging opposite edges of said screen when said screen is positioned on said platen and said third member is retracted inwardly, whereby said screen is placed in said alignment when each of said contact surfaces engages an edge of said screen.

In another aspect, the invention is related to a method for applying a stencil to a screen used in the printing of substrates in an ink transfer process and aligning said screen on a printing machine in preparation for said printing, said method comprising the steps of:

providing a first apparatus having a platen and extensible and retractable members on which contact surfaces are positioned for engaging opposite sides of said screen;

placing said screen on said first apparatus and retracting said members to bring the contact surfaces into engagement with said opposite sides of the screen and thereby aligning said screen in relation to alignment indicia provided on said platen;

placing a pattern for forming a stencil on said screen in overlying alignment with said alignment indicia provided on said platen;

removing said screen from the first apparatus and processing said screen to form an ink permeable stencil in said screen corresponding to a configuration of said pattern, said ink permeable stencil being surrounded by an area of generally ink impermeable material;

providing a second apparatus having a platen and associated extensible and retractable members on which contact surfaces are positioned for engaging opposite sides of said screen;

placing said processed screen on said second apparatus and retracting said associated members to bring the contact surfaces into engagement with said opposite sides of the screen at the same points of engagement on the screen and engaged by said contact surfaces of said first apparatus, whereby said screen is held in the same alignment on said second apparatus as on said first apparatus; and clamping said screen to a portion of said printing machine and removing said screen from said second apparatus.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figure 1:
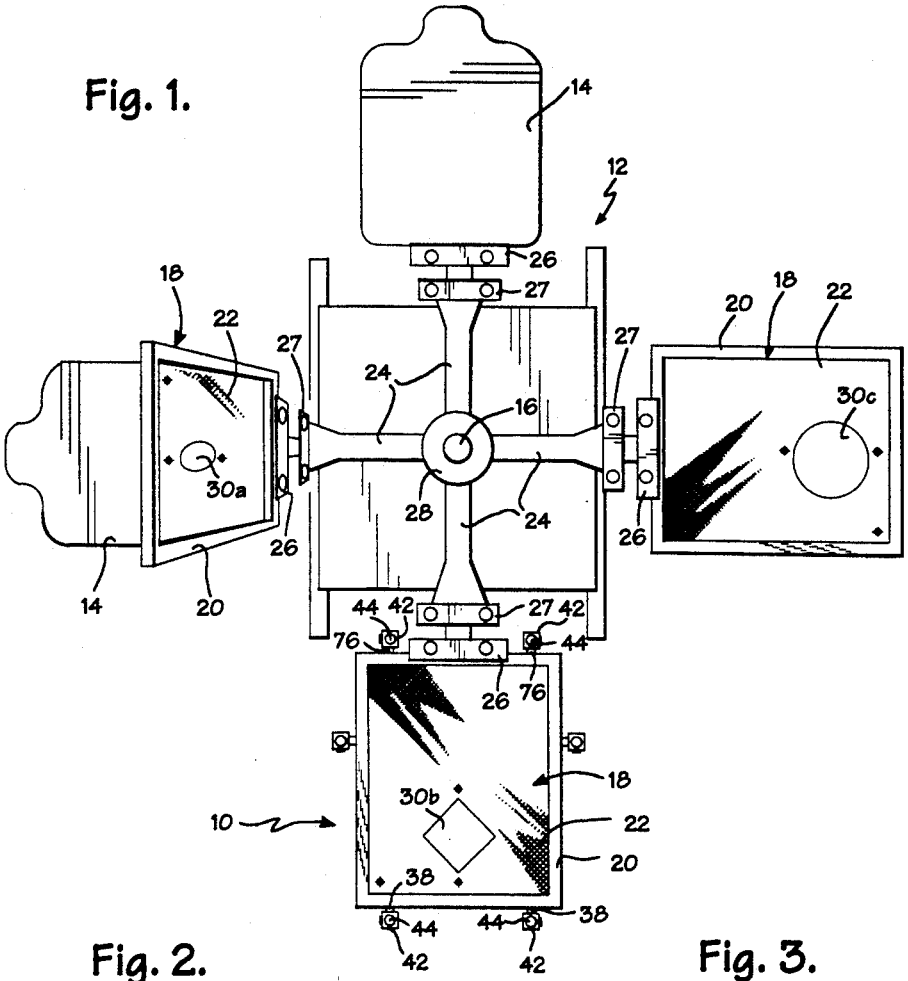
FIG. 1 is a top plan view, shown somewhat schematically, of a screen-type printing machine showing stenciled screens clamped to rotatable arms of the machine and with a screen registration apparatus in accordance with the present invention applied at one of the four printing board stations.

Referring now to the drawings in greater detail and initially to FIG. 1, a screen registration apparatus in accordance with the present invention is represented broadly by the numeral 10 and is shown applied to a manual type printing machine 12. Machine 12 is shown somewhat schematically since it is of generally conventional construction and is merely representative of but one of many types of manual as well as automatic printing machines with which screen registration apparatus 10 may be used.

In general, machine 12 comprises a plurality of printing boards 14, also commonly referred to as shirt boards, which are mounted on arms 15 (FIG. 10) for rotation about a center axis 16. Although four printing boards have been shown mounted on machine 12, it is to be understood that more or fewer boards may be provided. A plurality of screens 18 comprising a frame 20 and mesh material 22 are secured to arms 24 by clamps 26 and hinges 27. The arms 24 are fixed to a center cylindrical shaft 28 for rotation about axis 16 in a plane overlying the plane of rotation of the underlying arms 15 and printing boards 14. In some instances, the arms to which either the printing boards 14 or the screens 18 are coupled may be fixed so that they do not rotate. Desirably, however, both sets of arms are rotatable.

In conventional operation, printing machine 12 is used to apply ink patterns to substrates such as clothing and the like that are positioned on printing boards 14. The ink is applied through stenciled patterns 30*a*, 30*b* and 30*c* in screens 18, typically by the use of a squeegee to force the ink through the stencil in the screen and onto the underlying substrate positioned on one of the printing boards 14. The screens carrying patterns 30*a*, 30*b* and 30*c* are sequentially rotated in relation to the printing boards 14 to bring each screen and pattern into overlying relationship with the substrate to create a composite pattern on the substrate. Heating, drying and other well known processing steps may desirably be included in the operation of machine 12.

Figure 2:
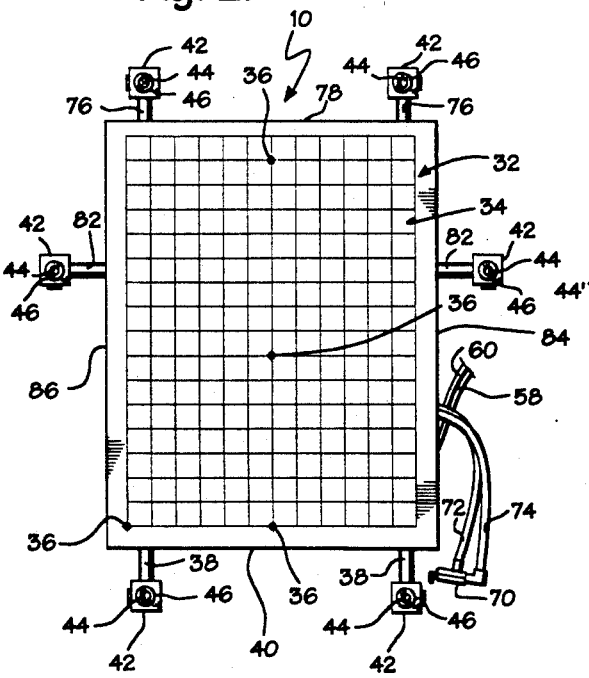
FIG. 2 is a top plan view showing a screen registration apparatus of the present invention for aligning the screens on the printing machine.

Turning to FIG. 2, screen registration apparatus 10 is used to align the screens 18 for clamping to the arms 24 of the printing machine 12 in order to ensure proper positioning of the stencils 30*a*, 30*b* and 30*c* in relation to the substrate to be printed. In accordance with the present invention, apparatus 10 comprises a rectilinear and generally flat platen 32 that includes optional indicia in the nature of a grid 34 and registration marks 36 that may be used to verify the alignment of the stencil 30*a*, 30*b* or 30*c* provided in an overlying screen.

The platen 32 of apparatus 10 is sized to support a substantial portion of screen mesh material 22 when the screen 18 is placed on the platen 32. A spaced apart pair of extendable and retractable rods 38 are coupled with an undersurface of platen 32 and extend outwardly beyond the peripheral edge at one end 40 of the platen. Each rod 38 carries a mounting block 42 which mounts an upright shaft 44. The shafts 44 extend upwardly beyond the plane of the top surface of platen 32 and each carries a rotatable sleeve-type roller bearing 46 which is positioned at a height for contacting the side of a screen frame 20 when the screen 18 is positioned on platen 32. Desirably, the mounting blocks 32 may be adjustably positioned along the length of rods 38 to accommodate screens 18 of various sizes. A key and slot arrangement (not shown) is provided to keep the mounting blocks 42 from rotating about rods 38.

Figure 4:
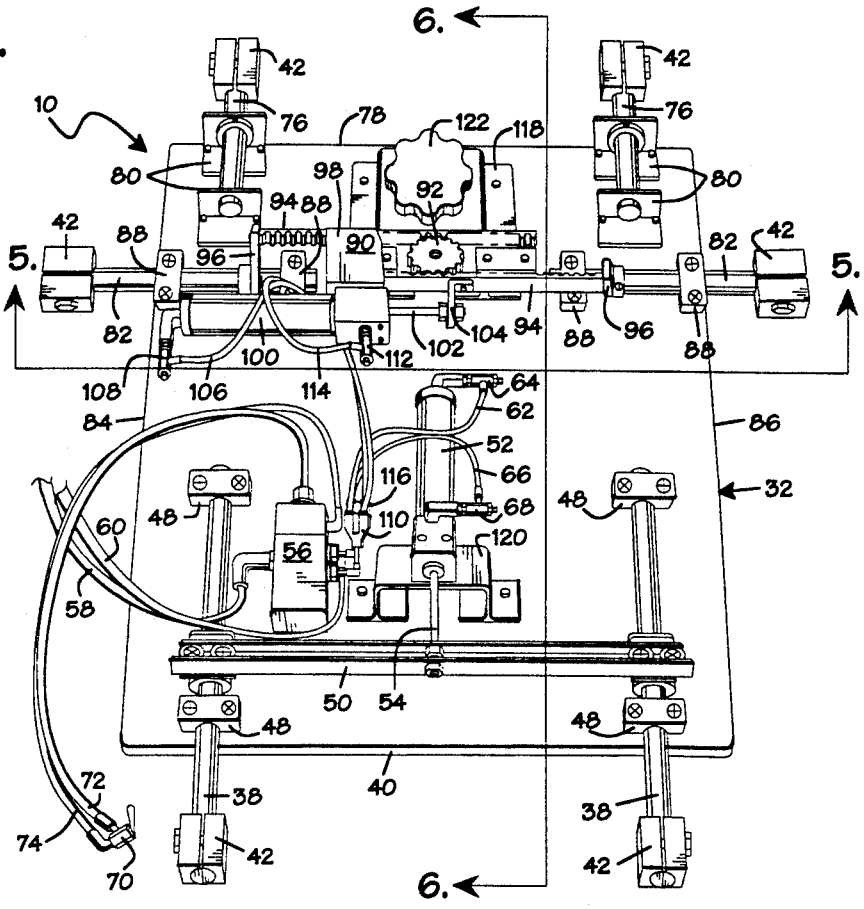
FIG. 4 is an enlarged perspective view showing the underside of the screen registration apparatus shown in FIG. 2.
Figure 5:
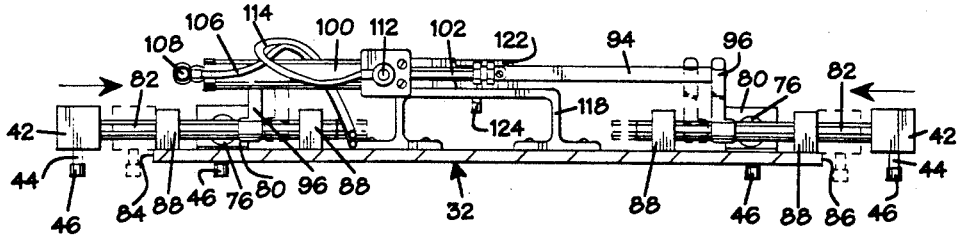
FIG. 5 is an elevational view of the screen registration apparatus taken in vertical section along line 5—5 in FIG. 4 in the direction of the arrows, and with movement of the side registration rods used to center the screen being illustrated by phantom lines.

Turning additionally to FIG. 4, the rods 38 are secured to the undersurface of platen 32 by a pair of spaced apart guide blocks 48 which also maintain the rods in alignment. A tie bar 50 is connected to both rods 38 so that extension or retraction of either of rods 38 causes like movement of the other rod 38. A double-acting air cylinder 52 is provided to effect extension and retraction of rods 38 by way of a piston rod 54 which is connected at a mid point of tie bar 50. Operation of air cylinder 52 is controlled by an air regulator 56 which is coupled with a source of compressed air by pneumatic lines 58 and 60. A flow line 62 then couples air regulator 56 with a suitable fitting 64 provided at one end of air cylinder 52 while another flow line 66 is connected to a fitting 68 provided at the other end of cylinder 52. When air is directed through line 62 to the cylinder, extension of piston rod 54 is effected. When air is directed to the other end of cylinder 52 through line 66, the piston rod is retracted. Air is cycled between the flow lines 62 and 66 by a toggle switch 70 which is connected by a feed line 72 and a return line 74 with the air regulator 56. It is to be understood that other mechanisms such as a single-acting air cylinder with a spring return may alternately be utilized in place of cylinder 52. The double acting cylinder 52 is preferred because it provides more positive movement of rods 38.

A pair of stationary rods 76 are provided at an opposite end 78 of platen 32 and extend in coaxial alignment with rods 38 provided at the other end 40 of the platen. Rods 76 likewise carry adjustable mounting blocks 42 and roller bearings 46 that are positioned on upright shafts 44. As is best shown in FIG. 4, the stationary rods 76 are each connected by a pair of brackets 80 to the undersurface of platen 32. Although in the preferred embodiment, the rods 76 are stationary, they could be mounted for extension and retraction in a manner similar to that provided for rods 38 located at the opposite end 40 of the platen.

Figure 6:
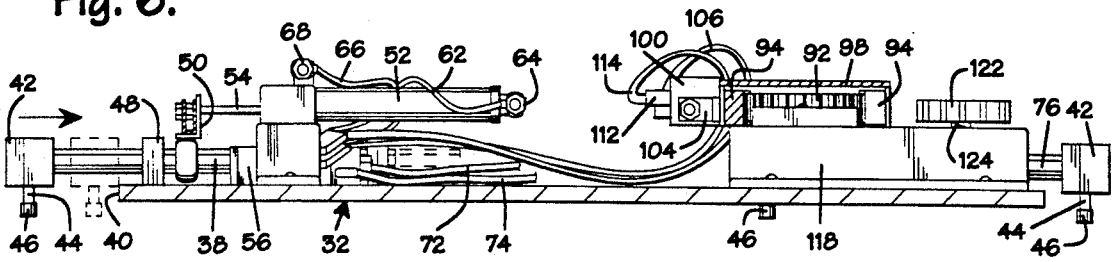
FIG. 6 is an elevational view of the screen registration apparatus taken in vertical section along line 6—6 in FIG. 4 in the direction of the arrows, and with movement of one of the end registration rods used to align the screen being illustrated by phantom lines.
Figure 10:
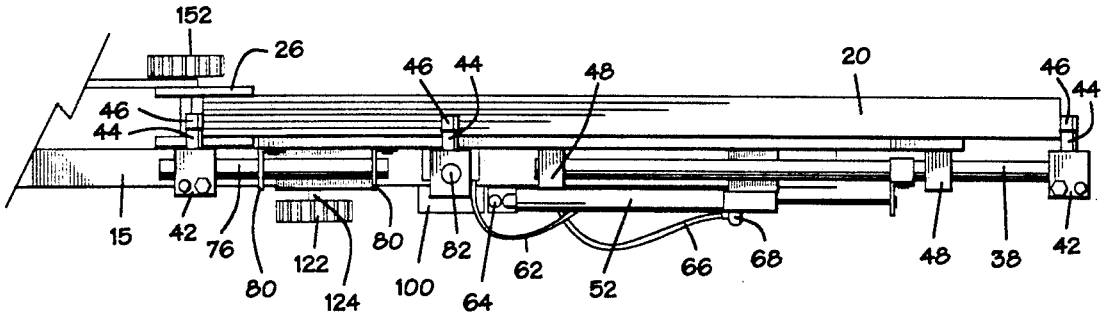
FIG. 10 is a side elevation view of the screen registration apparatus mounted on a lower arm of the printing machine and showing a screen which has been aligned by the apparatus and clamped to a rotatable upper arm of the printing machine, the lower and upper arms being shown in fragment.
Figure 11:
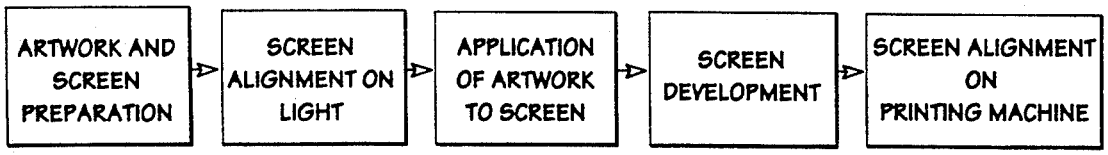
FIG. 11 is a block diagram showing an overall process for preparation and alignment of a pattern to a screen and alignment of the screen in relation to a substrate in accordance with the present invention.

As air cylinder 52 is activated to cause retraction of piston rod 54, the alignment rods 38 which are joined to the piston rod by tie bar 50 are likewise retracted to bring the upstanding alignment shafts 44 closer to platen edge 40, as is illustrated in FIG. 6. When the screen 18 is positioned on the top surface of platen 32, this movement of rods 38 brings the roller bearings 46 into contact with one side of screen frame 20, as can be seen in FIG. 10. Continued movement of the rods 38 then moves the screen toward the opposite end 76 of platen 32 until the screen frame 20 contacts the roller bearings 46 which are coupled with the stationery rods 78. This movement causes the screen 18 to be squared and aligned between the upstanding shafts 44 carried on the associated alignment rods 38 and 76. In addition, this movement causes the screen to be placed in a preselected position along the longitudinal axis of platen 32 as determined by the positioning of mounting blocks 42 on the stationary rods 76.

Lateral positioning of the screen 18 on platen 32 is effected by a pair of extensible and retractable side rods 82, one of which is positioned for extension beyond a side edge 84 of the platen while the other rod is mounted in coaxial alignment and extends beyond the opposite side edge 86. Each of rods 82 mounts a block 42 that carries an upstanding shaft 44 and roller bearing 46 as previously described.

As is best shown in FIG. 4, a pair of guide blocks 88 couple each side rod 82 to the undersurface of platen 32. The rods 82 are coupled together by a rack and pinion assembly 90 so that as one of the rods 82 is extended or retracted, the other rod is likewise extended or retracted in a like amount. It will be appreciated that a turn-screw and other mechanisms may be also used for this purpose in place of the rack and pinion assembly 90.

Rack and pinion assembly 90 includes a pinion gear that is centrally mounted between side edges 84 and 86 of the platen. A rack 94 is connected by a bracket 96 to one of rods 82 at a position between the guide blocks 88. Another rack 94 is likewise coupled by a bracket 96 to the other of rods 82. The parallel racks 94 are located on opposite sides of pinion gear 92 and are of sufficient length to provide the desired range of travel of rods 82. Each of racks 94 has a toothed inner surface (a portion of which is removed in FIG. 4 for clarity of illustration) which engages the similarly toothed pinion gear 92. The pinion gear 92 thus cooperates with racks 94 to translate movement of one of rods 82 in one direction to movement of the other rod 82 in the opposite direction. A cover 98 is provided to enclose portions of the rack and pinion assembly 90.

Movement of side alignment rods 82 is controlled by a double-acting cylinder 100 of the type previously described. A piston rod 102 extending from cylinder 100 is connected by a bracket 104 to one of racks 94 of the rack and pinion assembly 90. A flow line 106 is connected by a fitting 108 to one end of the air cylinder 100. The other end of flow line 106 is connected to the same port on air regulator 56 to which flow line 62 of air cylinder 52 is connected. A line splitter 110 is provided to divide the air flow between lines 106 and 62. A fitting 112 provided on the other end of air cylinder 100 is connected with a flow line 114 that is likewise connected by a splitter 116 to the same port servicing flow line 66 of the other air cylinder 52. The toggle switch 70 controls the air cylinder 100 in the same manner as previously described with respect to cylinder 52.

Preferably, air cylinder 100 is faster acting than cylinder 52 so that movement of side rods 82 is effected more quickly than movement of rods 38 upon activation of switch 70. This permits the bearings 46 carried by the side rods 82 to contact the sides of screen frame 20 first, followed by contact of the bearings 46 carried on end rods 38. The use of rotatable bearings 46 to contact the screen frame 20 is particularly advantageous in this regard because it permits the screen to be readily moved longitudinally even after the bearings are positioned on the sides of the frame.

The undersurface of platen 32 also includes a pair of spaced apart brackets 118 and 120 for receiving the arm 15 (FIG. 10) of printing machine 12 on which the printing boards 14 are normally mounted. Bracket 118 includes a knob 122 connected to a bolt 124 for bearing against the arm 15 to secure the platen thereto.

Figure 3:
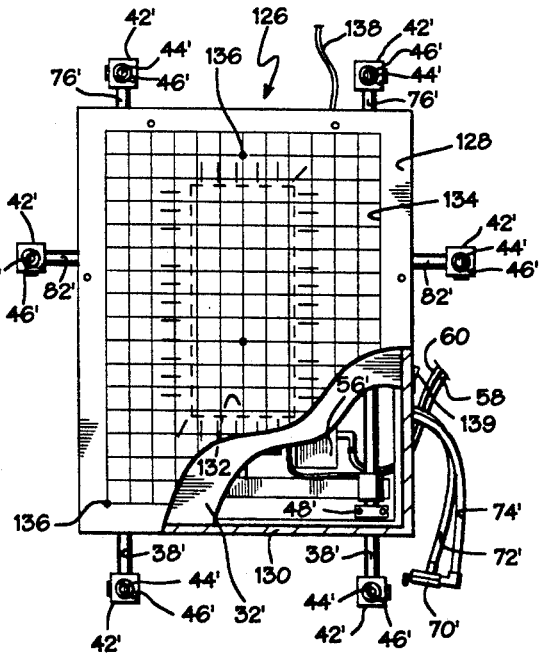
FIG. 3 is a top plan view showing a light box in accordance with the present invention useful for aligning a screen for application of a pattern to the screen, portions of the light box being broken away to illustrate internal components.

Turning now to FIG. 3, a light box 126 in accordance with the present invention will now be described. Light box 126 is used for application of artwork to the screens 18 and comprises a generally flat, translucent plate 128 which is connected to sidewalls 130. The plate 128 is tinted or otherwise treated to only allow passage of light in a spectrum which will not cause developing of the photosensitive emulsion provided on screens 18. A fluorescent or other suitable type of light 132 is provided adjacent the undersurface of plate 128 for illuminating the plate 128. Indicia, in the form of a grid 134 and registration marks 136 are provided on the plate 128 and are preferably identical to those previously described with respect to platen 32.

The sidewalls 130 and plate 128 of the light box 126 enclose a screen registration apparatus 137 which is substantially identical in construction and operation to apparatus 10 previously described. Consequently, a description of the like components and their operation need not be repeated with respect to apparatus 135. To facilitate identification of those like components, they are designated as prime with respect to apparatus 137. It will be appreciated that platen 32' which is provided with light box 126 need not contain alignment indicia such as grid 34 and registration marks 36 provided on platen 32 previously described. In addition, when screen 18 is placed on the light box 126, it is normally inverted from that orientation used when it is placed on apparatus 10. Because the mesh material 22 is normally placed on one face of screen frame 20, the frame when the screen is positioned on the light box extends downwardly a greater distance than when the screen is positioned on apparatus 10. Consequently, the bearings 46' carried by shafts 44' must be positioned accordingly to engage the screen frame 20 at the desired location, preferably midway between the top and bottom faces of the frame. An electrical lead 138 and a switch 139 are also provided for operation of light 132.

Light box 126 is utilized for alignment of screen 18 in relation to upstanding shafts 44' upon retraction of rods 38' and 82'. While the screen 18 is aligned on light box 126 and held by the shafts 44', a sheet 140 carrying a pattern 142*a* as well as registration marks 144 may be applied to the surface of the screen. The sheet 140 can then be aligned with the underlying grid 134 and/or registration marks 136 which are provided on light box 126 and Visible through the screen 20.

Figure 7:
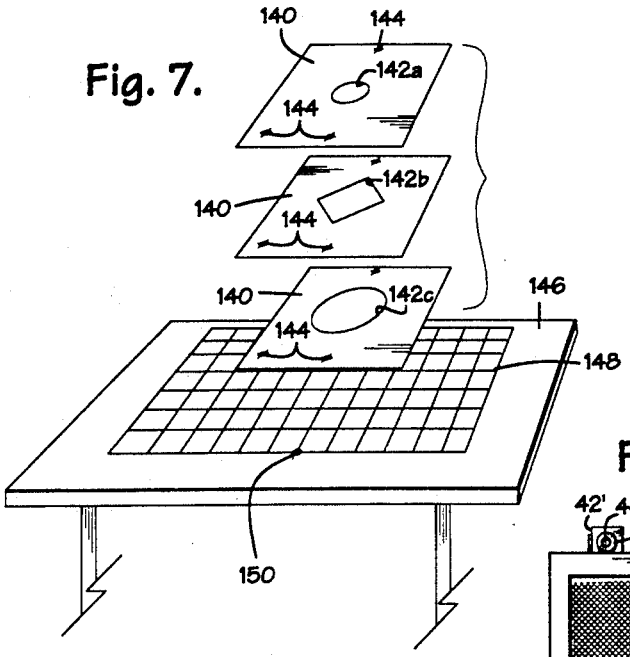
FIG. 7 is a fragmentary perspective view, shown somewhat schematically, of an artist's table and a series of pattern sheets, each of which will be applied to a separate screen to form a stencil which together will be used to form a composite pattern on a substrate.

Preparation of the sheets 140 can best be described with respect to FIG. 7 in which an artist's table is designated by the numeral 146. The artist's table 146 preferably carries on its top surface a grid 148 which is on the same scale as grids 34 and 134 provided on platen 32 and light box plate 128, respectively. The surface of the artist's table 146 also includes registration marks 150. A composite artwork pattern is created by placing individual patterns 142*a*, 142*b* and 142*c* on separate sheets 140 of clear acetate or similar translucent material. Registration marks 144 are then applied to each sheet 140 in alignment with the underlying registration marks provided on the surface of the artist's table 146. The number and positioning of the registration marks may be varied as desired for particular applications. In general, it is desirable for each sheet 140 to contain a centrally aligned registration mark 144 at one edge of the sheet and another registration mark located at the opposite edge of the sheet. It is to be understood that various alternatives may be utilized. For example, the registration marks in one alternative need appear only on the sheets 140 and not on the light box 126. In such case, positioning of sheets 140 on screens 18 may be accomplished solely by alignment of registration marks 144 with particular grid lines.

Figure 8:
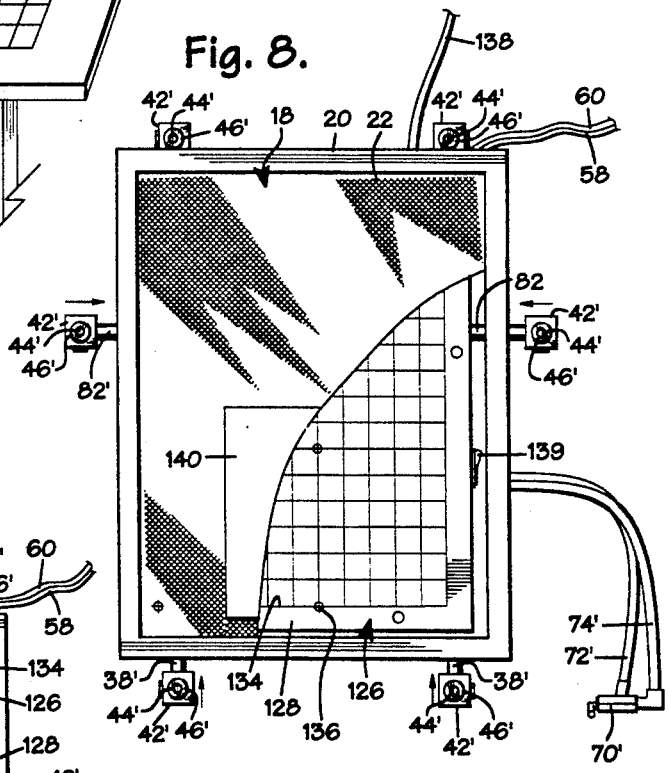
FIG. 8 is a top plan view of the light box shown in FIG. 3 but with a screen positioned on the box, portions of the screen being broken away to shown the underlying box and with arrows showing the direction of movement of the registration rods that will align the screen on the box.
Figure 9:
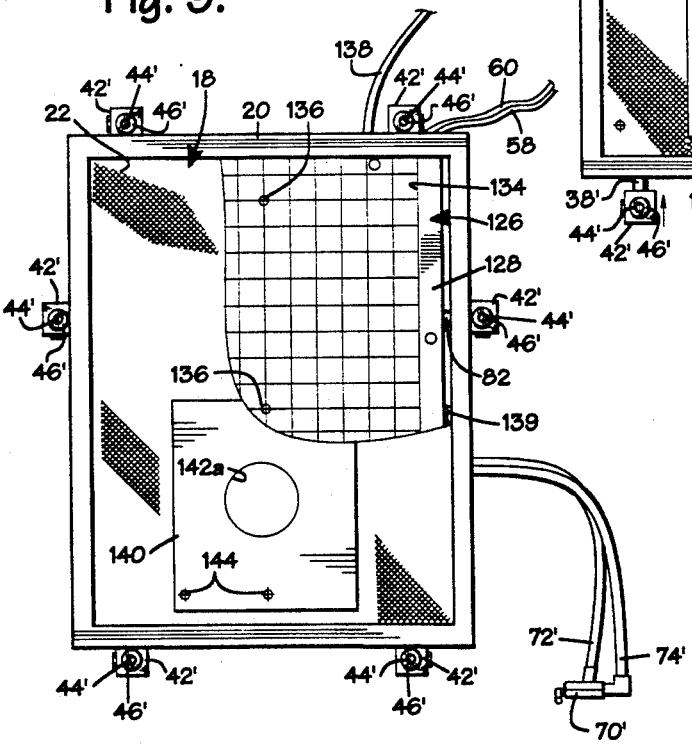
FIG. 9 is a top plan view of the light box apparatus and screen similar to that view shown in FIG. 8 but with the registration rods having been activated to align the screen on the box and with one of the pattern sheets shown in FIG. 7 having been applied to the screen in registry with the underlying grid and/or registration marks on the box, portions of the screen having been broken away to show underlying the box.

Once the artwork patterns 142*a*, 142*b* and 142*c* have been applied to sheets 140, they can be taped or otherwise applied to individual screens 18. As is well known in the art, the screens are first coated with a dried emulsion of a photosensitive material. The screen 18 is then applied to the light box 126 such as is shown in FIG. 8 and the toggle switch 70' is activated to cause retraction of arms 82' and 38' in the manner previously described. This causes the screen to be centered in a first direction in relation to the center ordinate of underlying grid 134. The screen 18 is aligned in a second direction which is perpendicular to the first direction and orients the screen in relation to the abscissa of the grid, as determined by the position of the upright shafts 44' carried by stationary rods 76'. Sheet 140 carrying pattern 142*a* may then be applied to the surface of screen 18 with the registration marks 144 on the sheet 140 allowing exact alignment of the pattern in relation to the underlying grid 134 and/or registration marks. Advantageously, because the screen 18 is firmly held in alignment by the upstanding shafts 44 on the arms 38, 76 and 82, the operator may use both hands to quickly position the sheet 140 in exact alignment.

Once the sheets 140 have been applied to screens 18, the screens are removed from the light box 126 and are exposed to a light source to cause curing of the emulsion that has been applied to the screen mesh material 22. Because the patterns 142*a*, 142*b* and 142*c* are opaque to the light, the emulsion which underlies these patterns does not cure and is then washed away to form a stencil corresponding to the patterns in the screens. Likewise, the registration marks 144 on the artwork sheets 140 do not permit passage of light to the underlying emulsion and corresponding stencils 150 are formed in those underlying areas as well. The process of developing screens to which a photosensitive emulsion has been applied is well known to those of skill in the art and further details need not be presented herein.

The screens 18 in which the stencils 30*a*, 30*b* and 30*c* have been formed may then be used for application of ink to an underlying substrate such as a clothing article. The screens 18 are generally impermeable to the ink except in those areas where the stencils 30*a*, 30*b* and 30*c* have been formed. Ink may be forced through the stencils upon the application of force such as by a squeegee or from a pressurized plenum.

In accordance with the present invention, the screens 18 which have been prepared as previously described are positioned by screen registration apparatus 10 for clamping on printing machine 12. The apparatus 10 is first applied to the printing machine 12 in place of one of printing boards 14. One of the screens 18 is then placed on platen 32 and brought into registry by simply moving the toggle switch 70 to cause the alignment arms 82 and 38 to retract and bring the roller bearings carried by those rods as well as stationary rods 76 into contact with all four sides of screen frame 20. Notably, because the rods 38, 76 and 82 are in exact alignment with rods 38', 76' and 82' of light box 126, the roller bearings 46 and 46' contacted the screen frame 20 at the same points of contact. Thus, any imperfections in the screen 20 will not cause misalignment of the screen 18 such as would occur if the screen were held at different points of contact while positioned on the light box 126 and screen registration apparatus 10.

Once the screen 20 has been aligned by the registration apparatus 10, it may be secured to the printing machine arms 24 by turning knob 152 to tighten clamp 26. The toggle switch 70 is again activated to cause extension of rods 38 and 82 to release the screen 18 from the registration apparatus 10. Alignment of the screen 18 can be verified at that point by observing whether the stenciled registration marks 150 are in alignment with the underlying grid 34 and/or registration marks 36 formed on platen 32. For this reason, it is important that the grid 34 and registration marks 36 be located on platen 32 in correspondence with the grid 134 and registration marks 136 formed on plate 128 of the light box 126.

Once alignment has been verified, aligned screen 18 is upwardly pivoted about hinge 27 and the arms 24 of machine 12 are rotated to bring the clamp 26 on the adjacent arm 24 into position with the registration apparatus 10 for receiving the next screen. Another screen 18 is then aligned and clamped in the manner as previously described. This process is repeated until the desired number of screens have been placed in registry on the printing machine 12. The screen registration apparatus 10 may then be removed and replaced with a printing board 14. Alternately, the registration apparatus 10 may be retained on the printing machine 12 during the subsequent printing operations.

As can be seen in FIG. 1, the process in accordance with the present invention can be briefly summarized as comprising the steps of preparing the artwork sheets 140 as well as the screens 18, aligning the screens 18 on the light box 126, applying the artwork sheets 140 on the screens, developing the screens 18 to form a stencil 30*a*, 30*b* or 30*c* therein, and then aligning the screens on the printing machine 12 using registration apparatus 10.

It will be appreciated that the screen registration apparatus 10 allows the screens 18 to be quickly placed in registry on the printing machine 12. The apparatus 10 and light box 126 are particularly adapted for allowing precise registration of the screens 18 because the screen frames are engaged at the same points of contact when positioned on the light box 126 as when positioned on registration apparatus 110. This is particularly important because the screen frames 20 are typically made of wood and frequently receive various nicks and dents which might otherwise cause misalignment of the screen. Even if the screen is registered on the light box with one of the bearings 46' in contact with a dent, the same registration will still be maintained when the screen is applied to registration apparatus 10 because the corresponding bearing 46 will contact the dent in the same manner.

Screen registration apparatus 10 and light box 126 are also constructed to readily accommodate screens of various sizes without the need for time consuming adjustments. If, however, an adjustment is desired in order to reduce the amount of travel before the bearings 46 are brought into contact with the screen frame 20, then mounting blocks 42 may be quickly moved along the rods and secured at the desired positions. A series of calibration marks (not shown) may be provided on the rods 38, 38', 82 and 82' for this purpose.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. An apparatus for positioning a framed ink-transfer screen in preselected alignment, said apparatus comprising:

a generally flat platen;

a first member coupled with said platen and extensible outwardly in a first direction at one side of said platen, said first member being retractable inwardly toward a first center axis on said platen;

a second member coupled with said platen and extensible outwardly in a second direction at an opposite side of said platen, said second member being retractable inwardly toward said first center axis and being operatively coupled with said first member so that extension or retraction of one of said first and second members causes corresponding extension or retraction of the other of said first and second members, each of said first and second members including a contact surface positioned for engaging opposite edges of said screen when said screen is positioned on said apparatus and said first and second members are retracted inwardly toward said first center axis;

a third member coupled with said platen and extensible outwardly in a third direction at a third side of said platen, said third member being retractable inwardly; and a fourth member coupled with said platen and positioned at a fourth side of said platen, each of said third and fourth members including a contact surface positioned for engaging opposite edges of said screen when said screen is positioned on said platen and said third member is retracted inward, whereby said screen is placed in said alignment when each of said contact surfaces engages an edge of said screen.

2. The apparatus of claim 1, including a rack and pinion assembly coupled with said first and second members to cause said operative coupling of said second member with said first member.

3. The apparatus of claim 2, wherein each of said contact surfaces of said first and second members comprises an upstanding shaft.

4. The apparatus of claim 3, wherein said upstanding shaft is positionable along the length of the associated member.

5. The apparatus of claim 3, wherein said upstanding shaft includes a bearing rotatable about an axis generally perpendicular to a longitudinal axis of the associated first or second member, said bearing having an outer surface presenting said contact surface.

6. The apparatus of claim 3, including a cylinder coupled with one or both of said first and second members for effecting extension and retraction thereof.

7. The apparatus of claim 6, including a fifth member coupled with said platen and spaced from said third member at said third side of said platen, said fifth member being extensible outwardly in said third direction and retractable inwardly and including a contact surface positioned for engaging for the same edge of said screen as engaged by said third member.

8. The apparatus of claim 7, including alignment indicia positioned on said platen for providing visual markers for positioning of patterns on said screen when said screen is aligned on said platen.

9. The apparatus of claim 8, wherein said indicia include a grid.

10. The apparatus of claim 8, including a light source positioned beneath a top surface of said platen and wherein said platen top surface comprises a material translucent to said light source.

11. An apparatus for positioning an ink-transfer screen in preselected alignment, said screen having a generally rectilinear frame and said apparatus comprising:

a generally flat platen;

a first member coupled with said platen and extensible outwardly in a first direction at one edge of said platen, said first member being retractable inwardly toward a first center axis on said platen;

a second member coupled with said platen and extensible outwardly in a second direction at an opposite edge of said platen, said second direction being opposite to said first direction, said second member being retractable inwardly toward said first center axis and being operatively coupled with said first member so that extension or retraction of one of said first and second members causes corresponding extension or retraction of the other of said first and second members, each of said first and second members including a contact surface positioned for engaging opposite sides of said screen when said screen is positioned on said apparatus and said first and second members are retracted inwardly toward said first center axis;

a third member coupled with said platen and extensible outwardly in a third direction at a third edge of said platen, said third member being perpendicular to said first and second directions and said third member being retractable inwardly; and a fourth member coupled with said platen and positioned at a fourth edge of said platen, each of said third and fourth members including a contact surface positioned for engaging opposite sides of said screen when said screen is positioned on said platen and said third member is retracted inward, whereby said screen is placed in said alignment when each of said contact surfaces engages a side of said screen.

12. The apparatus of claim 11, including a rack and pinion assembly coupled with said first and second members to cause said operative coupling of said second member with said first member.

13. The apparatus of claim 12, wherein each of said contact surfaces of said first and second members comprises an upstanding shaft.

14. The apparatus of claim 13, wherein said upstanding shaft is positionable along the length of the associated member.

15. The apparatus of claim 13, wherein said upstanding shaft includes a bearing rotatable about an axis generally perpendicular to a longitudinal axis of the associated first or second member, said bearing having an outer surface presenting said contact surface.

16. The apparatus of claim 13, including a cylinder coupled with one or both of said first and second members for effecting extension and retraction thereof.

17. The apparatus of claim 16, including a fifth member coupled with said platen and spaced from said third member at said third side of said platen, said fifth member being extensible outwardly in said third direction and retractable inwardly and including a contact surface positioned for engaging for the same edge of said screen as engaged by said third member.

18. The apparatus of claim 17, including alignment indicia positioned on said platen for providing visual markers for positioning of patterns on said screen when said screen is aligned on said platen.

19. The apparatus of claim 18, wherein said indicia include a grid.

20. The apparatus of claim 18, including a light source positioned beneath a top surface of said platen and wherein said platen top surface comprises a material translucent to said light source.

21. A method for applying a stencil to a screen used in the printing of substrates in an ink transfer process and aligning said screen on a printing machine in preparation for said printing, said method comprising the steps of:

providing a first apparatus having a platen and extensible and retractable members on which contact surfaces are positioned for engaging opposite sides of said screen;

placing said screen on said first apparatus and retracting said members to bring the contact surfaces into engagement with said opposite sides of the screen and thereby aligning said screen in relation to alignment indicia provided on said platen;

placing a pattern for forming a stencil on said screen in overlying alignment with said alignment indicia provided on said platen;

removing said screen from the first apparatus and processing said screen to form an ink permeable stencil in said screen corresponding to a configuration of said pattern, said ink permeable stencil being surrounded by an area of generally ink impermeable material;

providing a second apparatus having a platen and associated extensible and retractable members on which contact surfaces are positioned for engaging opposite sides of said screen;

placing said processed screen on said second apparatus and retracting said associated members to bring the contact surfaces into engagement with said opposite sides of the screen at the same points of engagement on the screen and engaged by said contact surfaces of said first apparatus, whereby said screen is held in the same alignment on said second apparatus as on said first apparatus; and clamping said screen to a portion of said printing machine and removing said screen from said second apparatus.

22. The method of claim 21, including the steps of removing the second apparatus after said screen has been aligned and clamped and then positioning a printing board in underlying relationship to the screen.

* * * * *